US005540134A

United States Patent [19]

Bird, Jr.

[11] Patent Number: 5,540,134

[45] Date of Patent: Jul. 30, 1996

[54] ALTERNATOR DRIVEN ELECTROMAGNETIC LAUNCHING SYSTEM

[75] Inventor: William L. Bird, Jr., Scotia, N.Y.

[73] Assignee: Martin Marietta Corporation, Bethesda, Md.

[21] Appl. No.: 869,513

[22] Filed: Jun. 2, 1986

[51] Int. Cl.[6] ..... F42B 6/00

[52] U.S. Cl. ..... 89/8; 124/3; 310/12

[58] Field of Search ..... 89/8; 124/3; 310/10–14; 318/135; 307/106–108

[56] References Cited

U.S. PATENT DOCUMENTS

| | | | |
|---|---|---|---|
| H123, | 9/1986 | Wright, Jr. | 310/12 X |
| 4,319,168 | 3/1982 | Kemeny | 89/8 X |
| 4,329,971 | 5/1982 | Kemeny et al. | 124/3 |
| 4,343,223 | 8/1982 | Hawke et al. | 124/3 X |
| 4,423,662 | 1/1984 | McAllister | 89/8 |
| 4,437,383 | 3/1984 | Deis et al. | 89/8 |
| 4,449,441 | 5/1984 | McAllister | 89/8 |
| 4,480,523 | 11/1984 | Young et al. | 89/8 |
| 4,485,720 | 12/1984 | Kemeny | 89/8 |
| 4,555,972 | 12/1985 | Heyne | 89/8 |
| 4,572,964 | 2/1986 | Honig | 89/8 |

FOREIGN PATENT DOCUMENTS

| | | | |
|---|---|---|---|
| 3319998 | 2/1984 | Germany | 89/8 |

OTHER PUBLICATIONS

E. M. Honig, "240–KA Switch With Potential Application in Electromagnetic Launch Systems", Los Alamos LA–UR–83–2710, Oct. 1983.

R. S. Hawke et al, "Electromagnetic Railgun Launchers: Direct Launch Feasibility", AIAA Journal vol. 20, No. 7, Jul. 1982, pp. 978–985.

"A Compulsator Driven Rapid–Fire EM Gun", IEEE Transactions on Magnetics, vol. MAG–20, No. 2, Mar. 1984, pp. 211–214, S. B. Pratap et al.

"High–Power–Density Super conducting Generator", Journal of Energy, vol. 6, No. 1, Jan./Feb. 1982, pp. 38–44, B. B. Gamble et al.

"A Superconducting Generator Design for Airborne Applications", 1979 Cryogenic Engineering Conference University of Wisconsin at Madison.

Wisconsin, Aug. 21–24, 479, B. B. Gronble et al.

*Primary Examiner*—Stephen C. Bentley

*Attorney, Agent, or Firm*—Robert A. Cahill; Geoffrey H. Krauss

[57] ABSTRACT

A superconducting single phase alternator is connected by a circuit breaker across the breech ends of a pair of conductive launching rails. At a predetermined point on the alternator voltage wave a projectile establishes a current path between the rails to initiate a transient, sinusoidal current pulse effective in accelerating the projectile along the rails. A switch is actuated in response to the projectile exiting the muzzle ends of the rails to impose a short circuit across the rails. The circuit breaker disconnects the alternator from the rails as the current pulse goes to zero. The system provides higher launcher efficiency and reduced muzzle flash with minimum barrel length penalty.

3 Claims, 3 Drawing Sheets

ALTERNATOR DRIVEN ELECTROMAGNETIC LAUNCHING SYSTEM

BACKGROUND OF THE INVENTION

The present invention relates to electromagnetic projectile launchers and particularly to an improved electromagnetic launcher which is driven by a single phase alternator with superconducting excitation.

Heretofore, electromagnetic projectile launchers have generally utilized a source of high DC current which is applied to a pair of parallel, elongated current rails. A projectile is equipped with brushes which make sliding electrical contact with these rails. The flow path of this high DC current conducted between the rails by these brushes and the attendant magnetic fields can be made to interact in ways well known in the art to develop tremendous accelerating forces propelling the projectile along the rails to desired high exit velocities. Alternatively, the projectile may be equipped with an insulating sabot designed to set up plasma arcs for conducting the DC current between the rails. Typical sources of the high DC current are homopolar or acyclic generators and capacitor banks. U.S. Pat. Nos. 4,423,662; 4,437,383; 4,449,441; 4,480,523; 4,485,720; and 4,555,972 are representative disclosures of homopolar generator driven electromagnetic launchers.

One of the principal objectives of any electromagnetic launcher design is the achievement of a desirably high projectile exit or muzzle velocity consistent with a reasonable rail or barrel length. It will be appreciated that if the barrel is too long, it can not be readily slewed to follow a moving target. To achieve a barrel of reasonably slewable length, acceleration of the projectile through the barrel must be increased. Since acceleration is proportional to the square of the current, this means that the current must be increased. However, any projectile has a limit to the magnitude of accelerating forces it can withstand. Peak acceleration and thus peak current must therefore be held below the accelerating force withstand limits of the projectile. Consequently, the acceleration profile over the barrel length should be reasonably flat such that the ratio of average acceleration to peak acceleration approaches unity. Thus, the current should have as close to a square pulse waveform as possible in order to achieve the desired exit velocity in the shortest possible barrel length. Homopolar generators have been found to be the most practical source of such a high magnitude, essentially square current pulse.

There is however a very significant problem engendered by this essentially square current pulse. At the moment the projectile exits the muzzle, the current is still at a very high level. Tremendous energy is thus stored in the inductances of the rails and the generator. The result is violant arcing between the rails, together with an intense flash which is easily detectable from a considerable distance. This so-called "muzzle blast" causes erosion and thermal damage to the muzzle ends of the rails. As evidenced by the above-cited U.S. Pat. Nos. 4,423,662 and 4,437,383, it has been proposed to permanently connect an impedance across the muzzle ends of the rails and into which the arcing current occasioned by the exiting projectile is commutated. Muzzle arcing is thus suppessed.

For these reasons, in an article entitled "A Compulsator Driven Rapid-Fire EM Gun" appearing in IEEE Transactions on Magnetics, Vol. Mag.-20, Mar. 1984, co-authored by the applicant herein, it was proposed to use an iron core single phase pulsed alternator to drive an electromagnetic launcher. The purpose of utilizing an AC waveshape was to increase launcher efficiency and reduce muzzle blast by timing the projectile exit at the muzzle to occur just prior to the naturally occurring current zero to facilitate interruption. The problem with this approach was twofold: a) the poor form factor of the current waveshape increased barrel length for a specified projectile muzzle velocity and peak acceleration; and b) the mass of the all iron system was excessive for practical kinetic energy weapons and other further applications. While this article recognizes the possibility of increasing muzzle velocity by initiating the discharge earlier at a different voltage firing angle, the penalty of lower launcher efficiency and the re-introduction of muzzle flash was considered unacceptable.

It is accordingly an object of the present invention to provide an improved electromagnetic launching system.

A further object is to provide an electromagnetic launching system of the above character which is driven by a single phase, pulse rated, alternating current generator with superconducting excitation.

Another object of the present invention is to provide an electromagnetic launching system of the above-character, wherein the magnitude of residual energy in the launching system at the time of projectile exit is reduced.

Yet another object is to provide an electromagnetic launching system of the above-character wherein high exit velocities are achievable while maintaining the barrel at a reasonable length.

A still further object is to provide an electromagnetic launching system of the above-character wherein muzzle blast is effectively and efficiently suppressed.

Other objects of the invention will in part be obvious and in part appear hereinafter.

SUMMARY OF THE INVENTION

In accordance with the present invention, there is provided an electromagnetic launching system including a pair of generally parallel, conductive launching rails which are connected at their breech ends to a high AC current superconducting alternator through a circuit breaker. A projectile, poised at the breech ends of the rails, includes means for establishing a current path between the rails. With the circuit breaker closed, the alternator is driven up to speed. At a predetermined point on the alternator voltage wave, the current path between the rails is established, and the projectile is accelerated along the rails toward their muzzle ends. As the projectile exits the launching rails, a switch is actuated to impose a short circuit across the muzzle ends of the rails. Muzzle blast is thus suppressed, and the energy stored in the rail inductance is efficiently returned to the alternator. To prevent oscillation, the circuit breaker operates to interrupt the circuit. Preferably, this interruption is effected as the generally sinusoidal, halfwave driving current pulse goes to zero.

The invention accordingly compresses the features of construction, combination of elements, and arrangement of parts, which will be exemplified in the construction hereinafter set forth, and the scope of the invention will be indicated in the claims.

For a full understanding of the nature and objects of the present invention, reference should be had to the following detailed description taken in conjunction with the accompanying drawings, in which.

DETAILED DESCRIPTION

Figure 1:
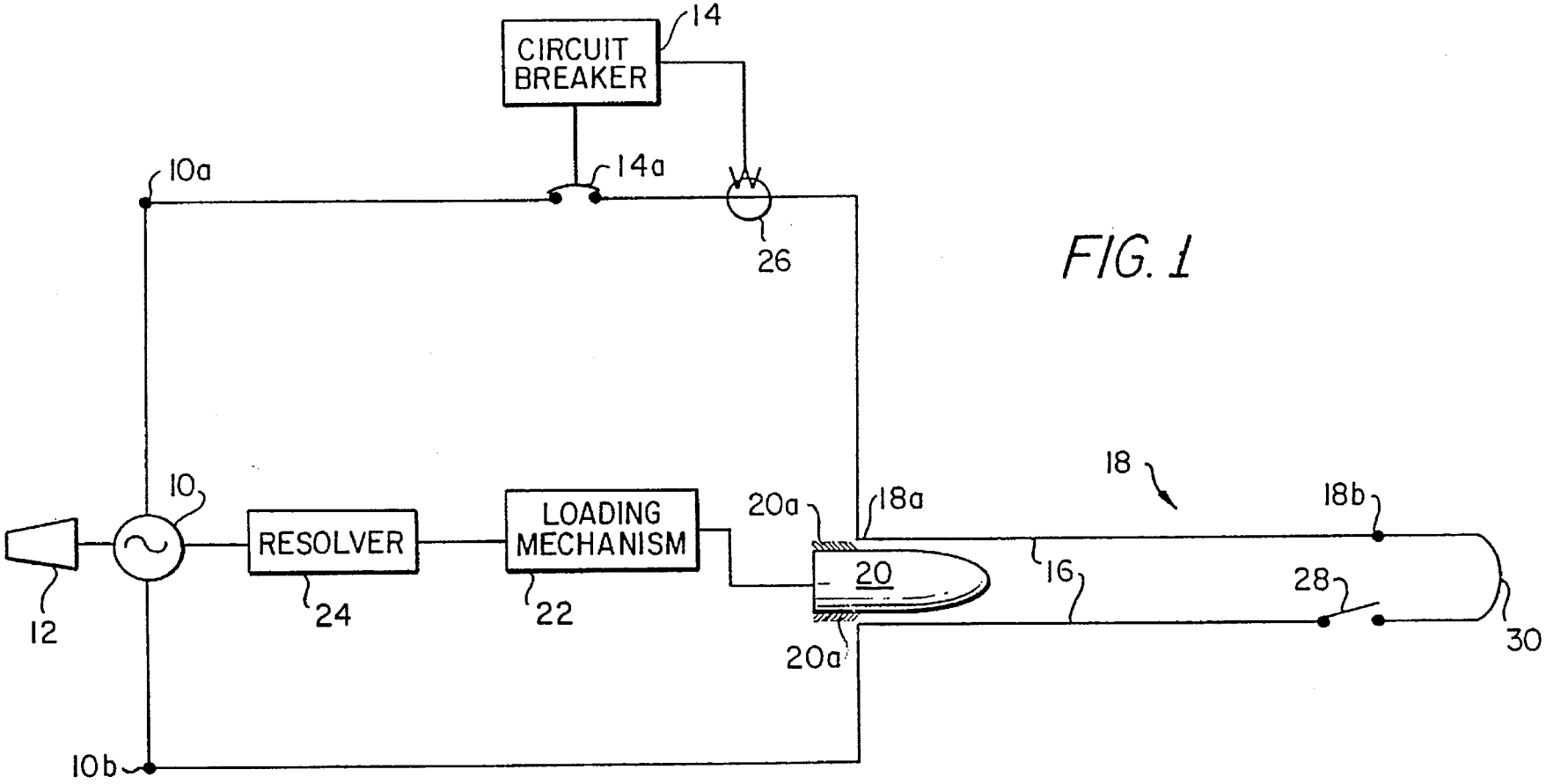
FIG. 1 is a schematic diagram of an electromagnetic launching system constructed in accordance with the present invention.

The electromagnetic launching system of the present invention includes, as illustrated in FIG. 1, a single phase, pulse duty, superconducting, AC generator or alternator 10 which is driven by a suitable prime mover 12, such as a turbine. One terminal 10*a* of this alternator is connected via the contacts 14*a* of an AC circuit breaker 14 to the breech end of one rail 16 of a linear electromagnetic accelerator or launcher, generally indicated at 18. The other alternator terminal 10*b* is directly connected to the other launcher rail 16. As is well understood in the art, rails 16 are in the form of elongated high current conductors arranged in parallel relation for extension from the breech end 18*a* to the muzzle end 18*b* of launcher 18.

Readied at the breech end of the launcher is a mass or projectile 20 to be accelerated. This projectile is illustrated as being equipped with brushes 20*a* for making sliding electrical contact with rails 16 when the projectile is fully loaded into the breech end of the launcher. A loading mechanism 22 holds the projectile poised at the launcher breech 18*a* awaiting a desired moment of loading at which time the brushes 20*a* complete a current path between rails 16 at the breech end of the launcher. In accordance with the present invention, the desired moment of projectile loading is correlated with a predetermined point on the voltage wave generated by alternator 10 such as to achieve an appropriate firing phase angle between the voltage wave and the drive current pulse supplied to the launcher. To this end, a resolver 24 may be utilized to track the rotor position of alternator 10 and signal the loading mechanism to load the projectile when the rotor arrives at the position corresponding to predetermined point on the voltage wave. It is seen that until the projectile is loaded, the alternator output terminals are open-circuited, and thus the driving current pulse begins when the projectile brushes 20*a* complete the current path across the rails. It will be appreciated that instead of brushes, the projectile may be equipped with a sabot designed to support plasma arcs triggered at the desired point on the voltage wave to establish the requisite current path between the rails.

Circuit breaker 14 is equipped with suitable means 26, such as a current transformer or Rogowski coil, to signal an appropriate time for the circuit breaker to open its contacts 14*a* and interrupt the alternator driving circuit. Since extremely high current magnitudes are involved, for example 1.5 megamperes, the task of this circuit interruption is greatly simplified if the contacts 14*a* are opened as the driving current pulse goes to zero. Thus, as a feature of the present invention, current transformer 26 signals circuit breaker 14 to start opening its contacts as the current pulse approaches zero. Such zero-crossing or synchronous controls for tripping circuit breakers are well known in the art.

Completing the description of the structure shown in FIG. 1, launcher 18 is equipped at its muzzle end 18*b* with a switch 28 which is actuated to a closed and latched condition in response to the projectile exiting the launcher. It is seen that closure of this switch completes a short circuit 30 between rails 16 at their muzzle ends. When the current path between the rails is sustained by plasma arcs, this short circuit may take the form of a section of the rails 16 shorted together or a conductive cylinder electrically connected with the rails as shown. If the drive current pulse has not gone to zero by the time of projectile exit, the short circuit imposed by switch 28 effectively suppresses muzzle blast and cross range dispersion, in addition to returning the energy stored in the rail inductance to the alternator. Rail damage is avoided, and the alternator is readied more quickly for a second shot. As will be seen, it has been discovered that a desired exit velocity with a shorter barrel or launcher length is achieved if the firing phase angle is selected such that the drive current is still of a substantial magnitude (50–70% of peak) at the moment of projectile exit. Thus shorting switch 28 provides important benefits in terms of muzzle blast suppression and efficiency.

A suitable alternator 10 applicable to the present invention may be a single phase version of the alternators disclosed in the article by Gamble and Keim entitled "High-Power-Density Superconducting Generator" appearing in the Journal of Energy, Volume 6, No. 1, January–February 1982, pages 38–44 and in a paper entitled "A Superconducting Generator Design for Airborne Applications" which was presented by the same authors at the 1979 Cryogenic Engineering Conference, University of Wisconsin at Madison.

In the operation of the system illustrated in FIG. 1, with contacts 14*a* of circuit breaker 14 closed and the alternator brushgear retracted, alternator 10 is driven up to speed by turbine 12. The alternator brushgear is then moved into position and the alternator gear windings are excited. At the appropriate point on the alternator voltage wave, as determined by resolver 24, projectile 20 is loaded into the breech end 18*a* of launcher 18 to initiate the driving current pulse. The projectile is accelerated along rails 16 to a desired exit velocity of, for example, 3000 meters per second. As the projectile exits the launcher muzzle 18*b*, switch 28 is actuated to short circuit the muzzle ends of the rails, suppressing any muzzle blast and returning any residual energy stored in the rail inductance back to alternator 10. The length of shorted rail section or cylinder 30 is selected to afford sufficient time to commutate plasma arc current into this short circuit. As the drive current pulse goes to zero, circuit breaker 14 opens its contacts 14*a* to interrupt the alternator drive circuit to prevent oscillation and consequent rail damage.

Figure 2:
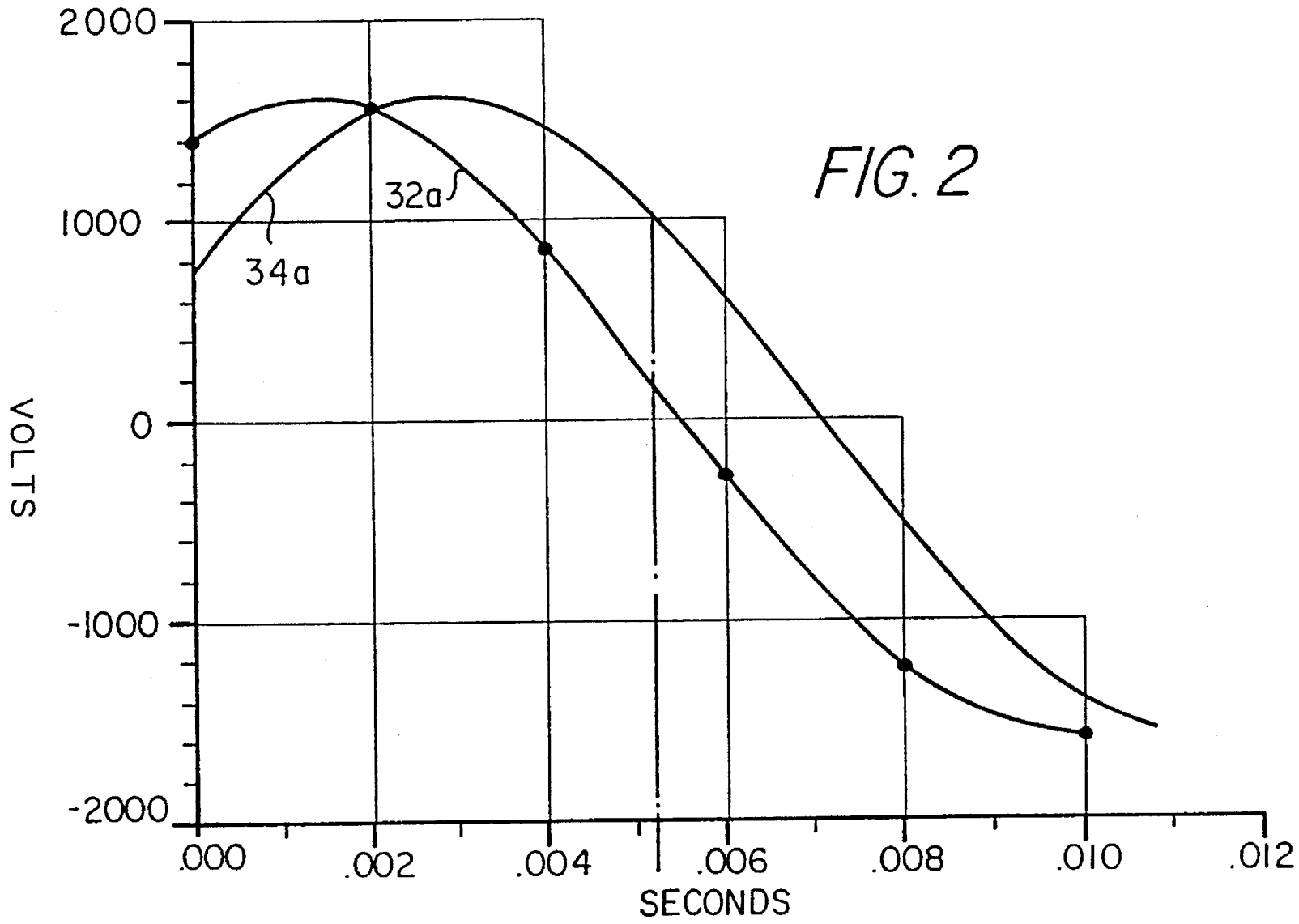
FIG. 2 is a graph of two voltage curves illustrating two different firing phase angles.
Figure 3:
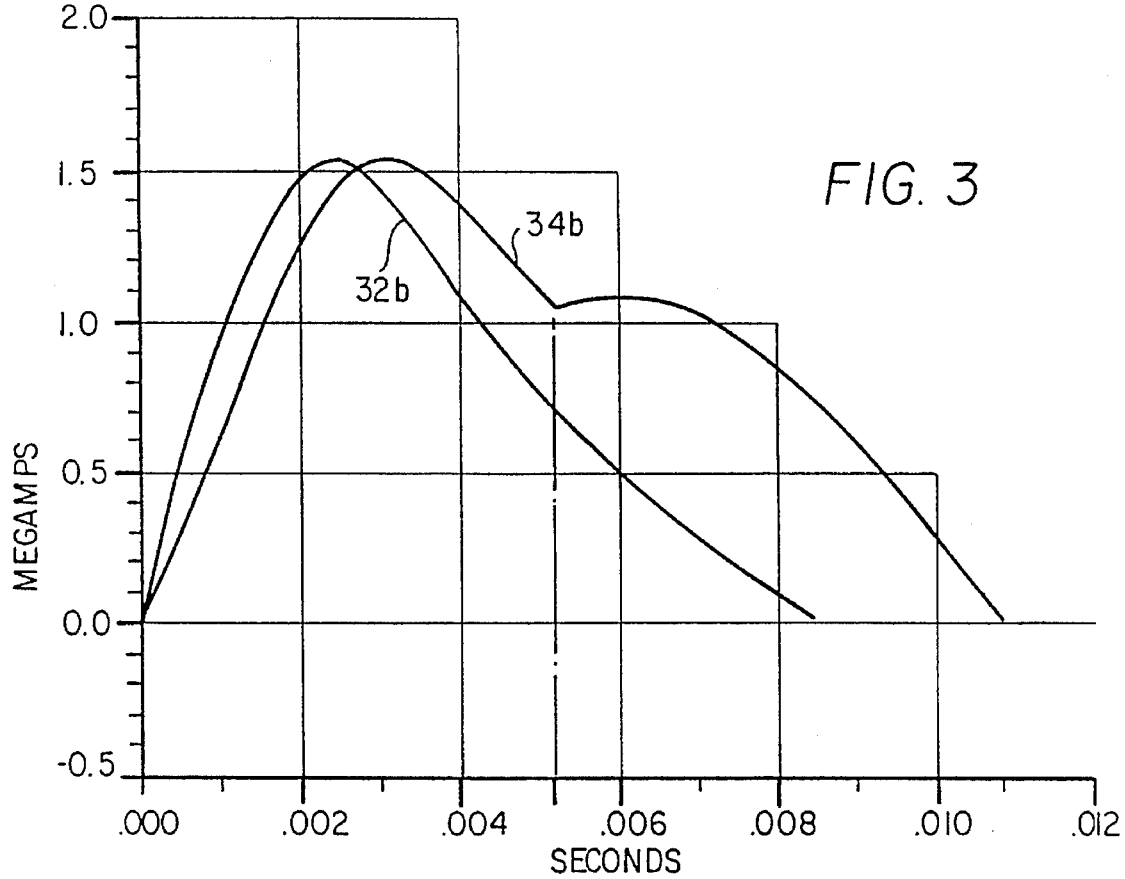
FIG. 3 is a graph of the generally sinusoidal driving current pulses achieved for the firing phase angles illustrated in FIG. 2.
Figure 4:
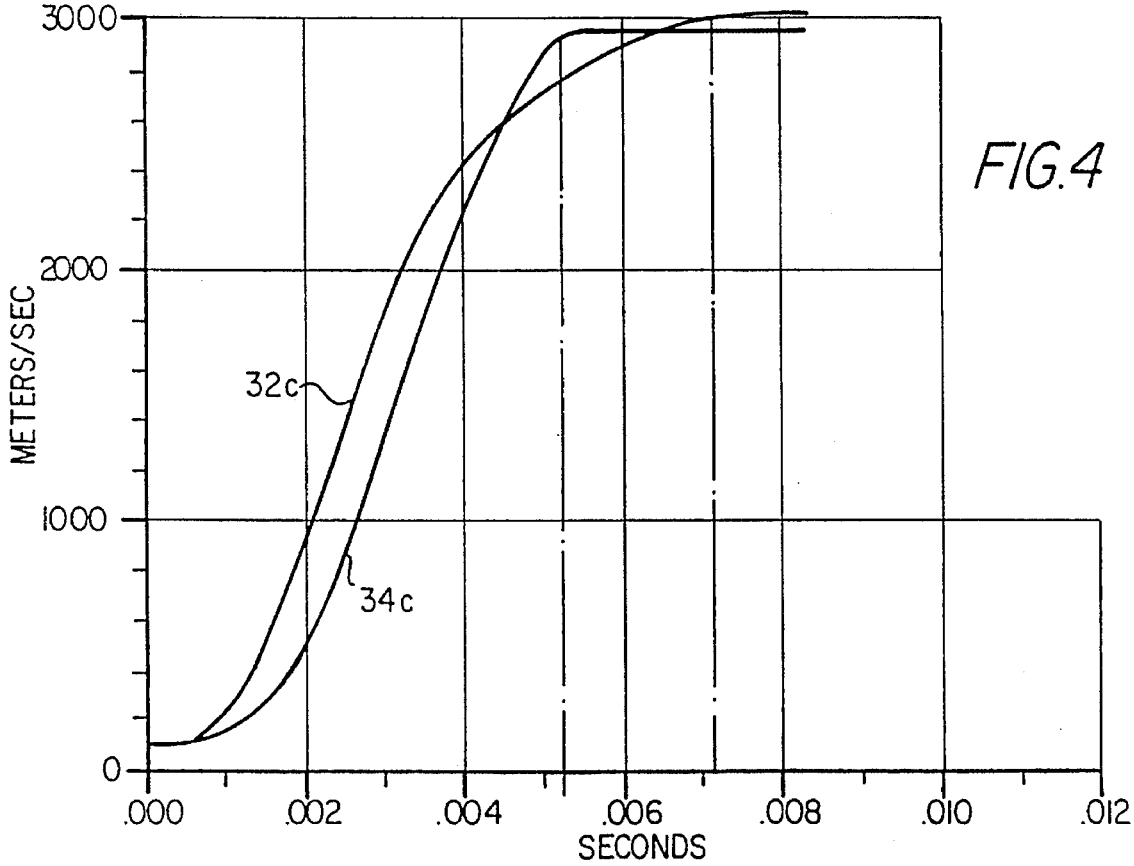
FIG. 4 is a graph of projectile velocity versus time for the two phase angle firing conditions illustrated in FIG. 2 and 3.

To appreciate the benefits obtained from appropriate phasing of the voltage and drive current, reference is had to FIGS. 2 through 4. Curve 32*a* represents the alternator voltage wave for the situation wherein the projectile is loaded into the launcher 62.7° into the positive half-cycle thereof to initiate the drive current pulse which is represented by curve 32*b* in FIG. 3. Thus, the drive current lags the alternator voltage by a phase angle of 62.7°. Curve 32*c* in FIG. 4 illustrates that, for a drive current pulse of the waveform illustrated by curve 32*b*, a desired projectile velocity of 3000 m/s is achieved in slightly over 7 ms. If projectile exit is delayed until approximately 8.5 ms into the shot, the advantages of a naturally occuring current zero are obtained, as seen in FIG. 3. Unfortunately, to achieve a coincidence of current zero and projectile exit with the desired velocity, it has been determined that launcher 18 would require a barrel length of 16.75 meters. Thus is far too long for most applications.

Curve 34*a* of FIG. 2 and curve 34*b* of FIG. 3 illustrate a firing phase angle of 27°, i.e., the current pulse lags the voltage wave by 27°. Curve 34*c* of FIG. 3 indicates that a projectile velocity just short of 3000 m/s is achieved approximately 4.2 ms into the shot. It is seen that this velocity curve 34*c* is substantially linear over the period from 2 to 4.2 ms, thus indicating a more uniform acceleration profile than is shown by velocity curve 32*c*. As a consequence, an acceptable exit or muzzle velocity can be achieved with the drive current wave 34*b* for a barrel length as short as 6.25 meters, which is quite acceptable from a slewing standpoint. By comparing curves 32*b* and 34*b*, it is seen that the ratio of average to peak current is higher in the case of the drive current pulse represented by curve 34*b*. Since acceleration is proportional to the square of the current, the ratio of average to peak acceleration is likewise beneficially higher. For the two firing phase angle conditions illustrated in FIGS. 2–4, the same projectile mass and launcher electrical characteristics are assumed in each case. The acceleration forces associated with the indicated 1.5 megampere current peaks are well within the withstand limits of typical projectiles.

Returning to FIG. 3, it is seen from curve 34*b* that when the projectile exits the launcher barrel 4.2 ms into the shot, the current pulse has only decayed to approximately 65% of its peak amplitude. Thereafter, the current rises slightly due to the reduced circuit impedance caused by the short circuiting action of switch 28 (FIG. 1). The current pulse then decays to its natural zero at approximately 10.8 ms into the shot, at which time circuit breaker 14 will have acted to interrupt the alternator drive circuit.

It will be appreciated that the illustrated 27° firing phase angle is merely exemplary. That is, the appropriate phasing of the drive current pulse relative to the voltage wave in order to achieve the desired muzzle velocity while minimizing barrel length depends on a variety of factors including the alternator rating, the launcher electrical and mechanical parameters, and the projectile mass and physical robustness.

It is thus seen that the objects set forth above, including those made apparent from the preceding description, are efficiently attained, and, since certain changes may be made in the above construction without departing from the scope of the invention, it is intended that all matter contained in the above description or shown in the accompanying drawings shall be interpreted as illustrative and not in a limiting sense.

Having described the invention, what is claimed as new and desired to secure by Letters Patent is:

1. An electromagnetic launching system comprising, in combination:

A. a superconducting single phase pulse rated AC generator;

B. a launcher including a pair of generally parallel, conductive rails extending from a breech end to a muzzle end of said launcher;

C. a projectile including means for conducting an AC current pulse between said rails to accelerate said projectile from said breech end toward said muzzle end of said launcher;

D. a circuit breaker electrically connecting said generator across said rails at said launcher breech end to conduct said current pulse thereto;

E. means responsive to said generator for initiating said current pulse at a predetermined point on the AC voltage wave generated by said generator to establish a predetermined phase relationship between said current pulse and said voltage wave such that said projectile exits said launcher muzzle end well before said current pulse goes to zero; and F. a switch actuated in response to said projectile exiting said launcher muzzle end for completing a short circuit between said rails.

2. The electromagnetic launching system defined in claim 1, wherein said circuit breaker includes means responsive to said current pulse for initiating interruption by said circuit breaker as said current pulse goes to zero after said projectile exits said launcher breech end.

3. The electromagnetic launching system defined in claim 2, wherein said generator responsive means establishes said predetermined phase relationship such that said current pulse is in the range of 50–70 percent of its peak amplitude at the time said projectile exits said launcher muzzle.

* * * * *